US011927360B2

(12) United States Patent
Ciuricov

(10) Patent No.: US 11,927,360 B2
(45) Date of Patent: Mar. 12, 2024

(54) AMBIENT LIGHTING AIR DIFFUSER ASSEMBLY

(71) Applicant: Victor Ciuricov, Las Vegas, NV (US)

(72) Inventor: Victor Ciuricov, Las Vegas, NV (US)

( * ) Notice: Subject to any disclaimer, the term of this patent is extended or adjusted under 35 U.S.C. 154(b) by 0 days.

(21) Appl. No.: 18/459,255

(22) Filed: Aug. 31, 2023

(65) Prior Publication Data

US 2023/0408136 A1 Dec. 21, 2023

Related U.S. Application Data

(63) Continuation-in-part of application No. 17/852,798, filed on Jun. 29, 2022, now Pat. No. 11,774,135.

(60) Provisional application No. 63/216,085, filed on Jun. 29, 2021.

(51) Int. Cl.
*F24F 13/075* (2006.01)
*F24F 13/078* (2006.01)

(52) U.S. Cl.
CPC ..... *F24F 13/075* (2013.01); *F24F 13/078* (2013.01)

(58) Field of Classification Search
CPC ..... F24F 13/075; F24F 13/078; F24F 13/28
USPC ..... 454/284
See application file for complete search history.

(56) References Cited

U.S. PATENT DOCUMENTS

| | | | |
|---|---|---|---|
| 5,573,458 | A | 11/1996 | Chu |
| 5,597,392 | A | 1/1997 | Hawkins |
| 6,030,427 | A | 2/2000 | Sorice |
| 6,234,893 | B1 | 5/2001 | Meredith |
| 6,379,412 | B1 | 4/2002 | Porterfield |
| 6,814,660 | B1 | 11/2004 | Cavett |
| 7,789,928 | B2 | 9/2010 | Stepp |
| 9,333,450 | B2 | 5/2016 | Hamlin |
| 9,644,862 | B1 | 5/2017 | Korte |
| 10,072,869 | B2 | 9/2018 | Zakula |
| 10,940,417 | B1 | 3/2021 | Bishop |
| 2014/0141709 | A1 | 5/2014 | Hammer |
| 2015/0292755 | A1 | 10/2015 | Pickett |

*Primary Examiner* — Avinash A Savani
*Assistant Examiner* — Dana K Tighe
(74) *Attorney, Agent, or Firm* — Kevin D. Everage; Dickinson Wright PLLC

(57) ABSTRACT

An air diffuser assembly for transferring airflow from an HVAC system to an environment. The air diffuser assembly comprises a body at least partially located in a duct of the HVAC system and a cover including at least one vent assembly for permitting airflow through the cover and into the environment. The cover provides ambient lighting and light powered disinfectant powered by a passive charging system.

20 Claims, 18 Drawing Sheets

AMBIENT LIGHTING AIR DIFFUSER ASSEMBLY

PRIORITY CLAIM

This application is a continuation-in-part of U.S. patent application Ser. No. 17/852,798 entitled "AIR DIFFUSER ASSEMBLY", filed on Jun. 29, 2022, which claims priority to and the benefit of U.S. provisional patent application No. 63/216,085 entitled "AIR DIFFUSER ASSEMBLY", filed on Jun. 29, 2021, which applications are expressly incorporated by reference herein.

BACKGROUND OF THE INVENTION

1. Field of Invention

The present invention relates to an air diffuser assembly for residential and commercial environments.

2. Introduction

This section provides background information related to the present disclosure which is not necessarily prior art.

Most modern residential and commercial buildings include heating, ventilation, and air condition (HVAC) systems. These HVAC systems control environmental factors such as temperature, humidity, and air quality via the circulation and redistribution of air through a manifold of air ducts. Movement of air is typically facilitated by at least one blower located within the manifold and the air can be thermally regulated before distribution by heating and cooling appliances. The air moves through the air ducts and into a room via a register that diffuses the air in various directions as it flows therethrough. The complexity of the HVAC system typically correlates with the number of distinct locations that are being regulated. For example, in small residential buildings, the HVAC system can be relatively uncomplicated as the air in only a small number of rooms needs to be regulated. In larger commercial properties, however, the HVAC system can be complicated to achieve numerous simultaneous requirements. For example, some areas within a commercial property may need to be cooled while others need to simultaneously be heated.

When air is being circulated and redistributed between numerous areas, concerns begin to arise about the transfer of germs and a degradation of air quality. Typically, HVAC systems include an air filter near the blower to improve air quality. While these air filters exhibit benefits to air quality, they can quickly become dirty and nonoptimal. More particularly, by locating the air filter near the blower, it is positioned to clean all the air at a central location in the manifold. In addition, because these typical air filters are located near the blower, they are under constant or near constant exposure to air at high speeds, thus decreasing effectiveness and blowing debris out of the air filter once it become dirty.

As such, there is a continuing desire to develop assemblies that improve upon air filtration within HVAC systems.

SUMMARY OF THE DISCLOSURE

This section provides a general summary of the disclosure and should not be interpreted as a complete and comprehensive listing of all the objects, aspects, features and advantages associated with the present disclosure.

It is therefore an aspect of the present disclosure to provide an air diffuser assembly for transferring airflow from a duct to an environment. The air diffuser assembly comprises a body for being at least partially located in the provided duct and a cover including at least one vent assembly for permitting airflow through the cover and into the environment. The body defines an aperture for transferring airflow from the duct and an air filter located in the aperture. The cover includes a closed position, wherein the cover is placed against the body to form a cavity, and an open position, wherein the cover is moved from the body to permit access to the filter. In other embodiments, the air diffuser assembly includes an ambient lighting system comprising LED lights, batteries, a passive charging system, a motion detector, and a photo sensor. Incorporation of the ambient lighting system with the air diffuser assembly reduces eye strain caused by standard lighting in dark environments. The ambient lighting system may also include ultraviolet lights to kill bacteria and disinfect an HVAC vent.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION

Example aspects will now be described more fully with reference to the accompanying drawings. In general, the subject aspects are directed to an air diffuser assembly for residential and commercial environments. However, the example embodiments are only provided so that this disclosure will be thorough, and will fully convey the scope to those who are skilled in the art. Numerous specific details are set forth such as aspects of specific components, devices, and methods, to provide a thorough understanding of aspects of the present disclosure. It will be apparent to those skilled in the art that specific details need not be employed, that example aspects may be embodied in many different forms and that neither should be construed to limit the scope of the disclosure. In some example aspects, well-known processes, well-known device structures, and well-known technologies are not described in detail.

Referring to the Figures, wherein like numerals indicate corresponding parts throughout the several views, an air diffuser assembly is provided. The air diffuser assembly provides an improvement over the art by providing an internal filter, a flow adjustment mechanism, and additional functional mechanisms.

Figure 1:
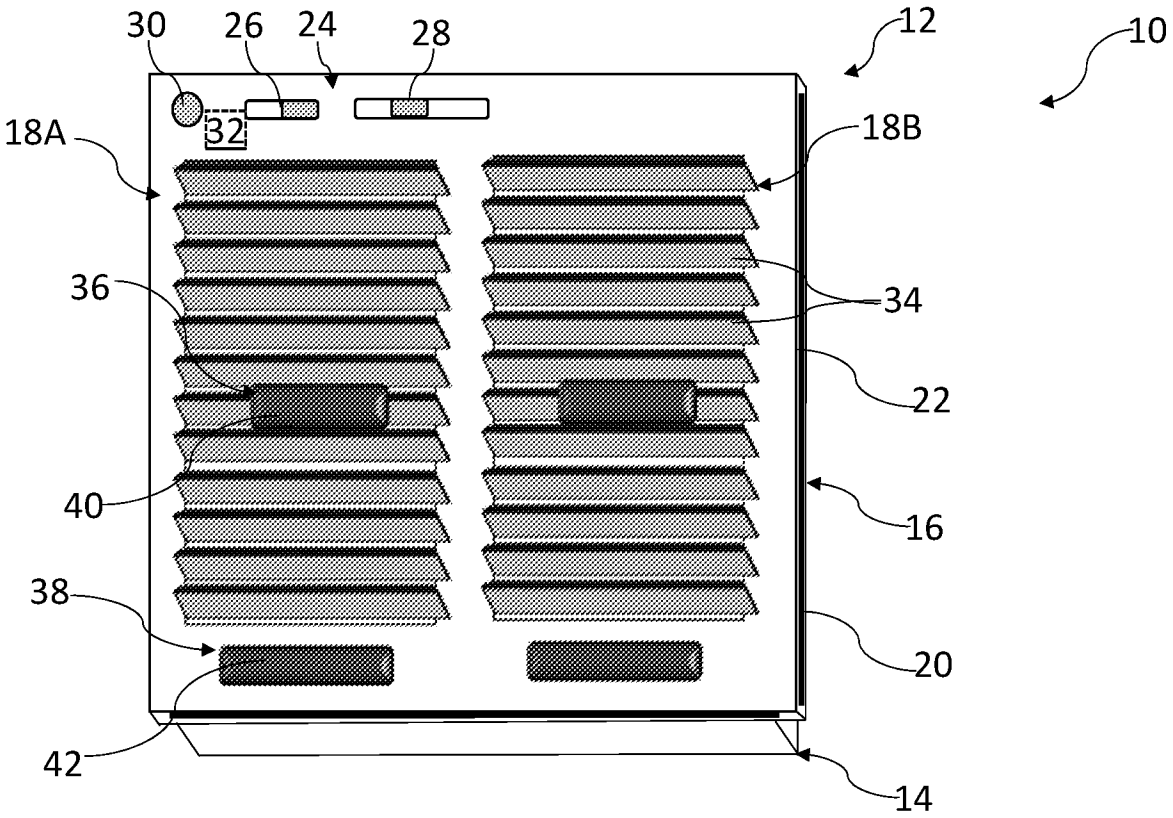
FIG. 1 is a perspective view of an air diffuser assembly in a closed position according to an aspect of the present disclosure.

Referring initially to FIG. 1, the air diffuser assembly 10 is generally illustrated. The air diffuser assembly 10 includes a housing 12 including a body 14 and a cover 16. The housing 12 includes a closed position (FIG. 1), wherein the cover 16 is placed directly over the body 14 and an open position (FIG. 2), wherein the cover 16 is pivoted away from the body 14. The cover 16 includes at least one air vent assembly 18 for directing an airflow through the cover 16. As will be described in further detail below, in some embodiments, the at least one air vent assembly 18 includes a plurality of air vent assemblies 18A, 18B, etc., that can be adjusted to direct air in a same direction or transverse directions.

The cover 16 includes at least one source of illumination 20. In some embodiments, the cover 16 includes an outer peripheral sidewall 22 defining a thickness and the source of illumination 20 is located on the peripheral sidewall 22. The source of illumination 20 may include light bulbs, LEDs, LED strips, electroluminescent material, other illumination means, or a combination thereof. In some embodiments, the source of illumination 20 extends over a majority of the peripheral sidewall 22. For example, the peripheral sidewall 22 may include four sections defining a rectilinearly shaped (e.g., rectangular) cover 16 and the source of illumination 20 may include a source of illumination 20 located on each of the four sections and extending over a majority of each of the four sections.

The cover 16 may further include a user interface 24 that includes a settings selector 26 and a brightness selector 28. The setting selector 26 may permit a user to change one or more illumination settings of the source of illumination 20. The illumination settings may include on/off settings for motion sensing, light detection, scheduled illumination, color of illumination, or combinations thereof. The cover 16 may further include one or more sensors 30, such as a motion sensor, an illumination sensor, or combinations thereof. Functionalities of the user interface 24 and sensors 30 may be controlled via a control system 32, for example, a PCB with a controller including a processor and a memory containing instructions that, when executed by the processor, cause the processor to perform the methods, systems, and functionalities as described herein.

With continued reference to FIG. 1, each of the air vent assemblies 18 may include a plurality of outer blades 34 for directing the airflow in a first direction and a plurality of inner blades 35 (FIG. 4) for directing the airflow in a second direction. As will be described in detail below, each of the vent assemblies 18 may further include a directional control 36 for adjusting the plurality of outer blades 24, the plurality of inner blades 35, and ultimately the direction of the airflow. Each of the vent assemblies 18 may further include a flow control 38 for adjusting an internal flow valve 37 and controlling the rate at which air is moved therethrough. In some embodiments, the directional control 36 may include a tab 40 connected to one of the outer blades 34 and the inner blades 35 and the flow control 38 may include a flow adjustment wheel 42.

Figure 2:
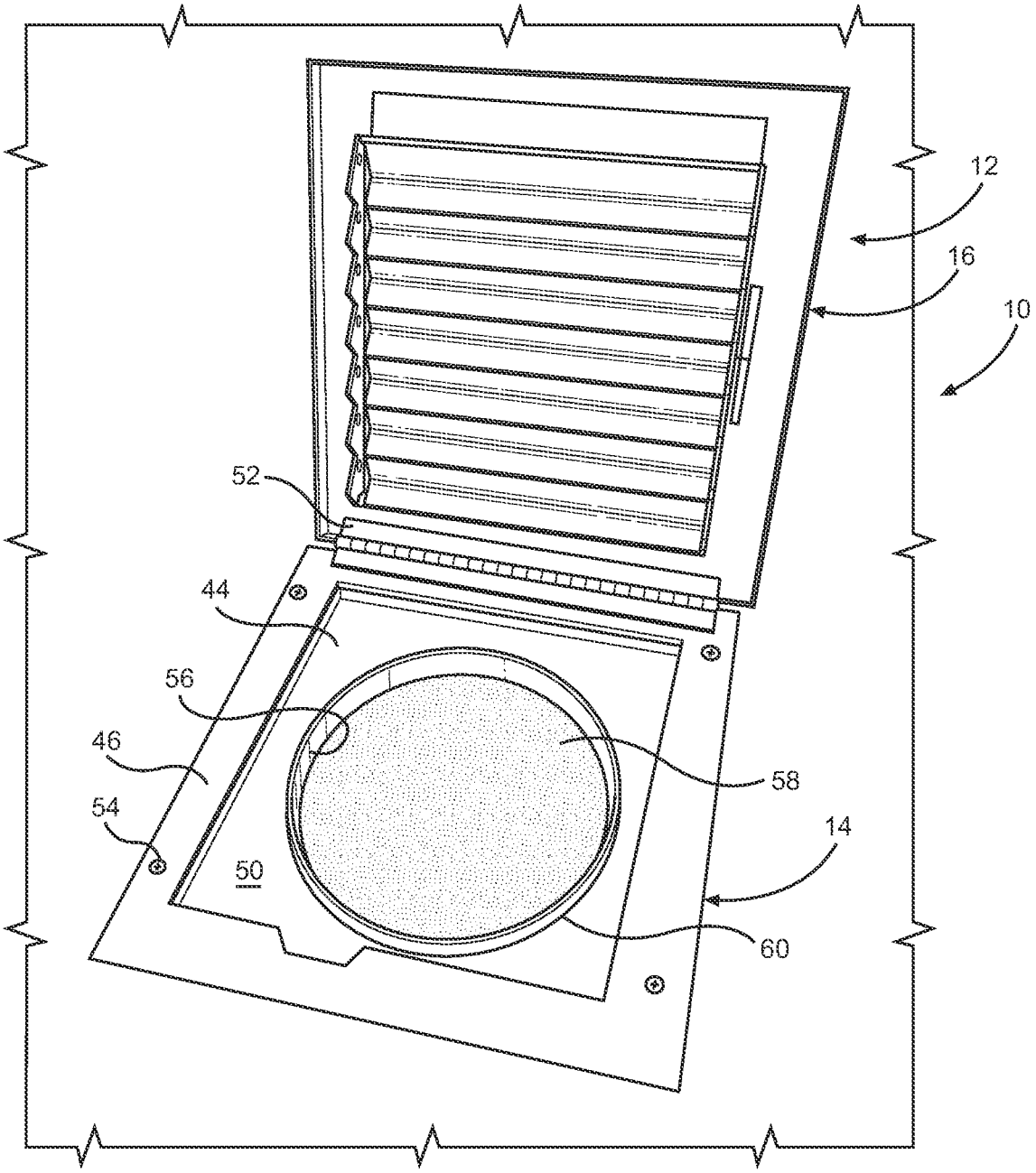
FIG. 2 is a perspective view of the air diffuser assembly in an open position according to an aspect of the present disclosure.

With reference now to FIG. 2, the air diffuser assembly 10 is illustrated in the open position. The body 14 includes a floor 44, a top flange 46, and a sidewall 48 extending from the floor 44 to the top flange 46. The body 14 and the cover 16 define a cavity 50 for locating various element of the air vent assemblies 18 and the control system 32. The body 14 connects to the cover 16 with at least one hinge 52. During installation, the sidewall 48 is sized to be located within an HVAC duct and the top flange 46 abuts a wall wherein it can be fastened thereto with fasteners 54. The floor 44 defines a floor aperture 56 for transferring airflow from the HVAC duct to the environment. At least one filter 58 is located within the floor aperture 56. The filter 58 may be formed of fiberglass, polyester (woven or non-woven), cotton, electrostatic material, high efficiency particulate air (HEPA) materials. The filter 58 may include an N95, N99, or an N100 rating. The filter 58 may include a MERV rating of 16 or below, 14 or below, 12 or below, 10 or below, 8 or below, 6 or below, or 4 or below. Therefore, depending on an end-use, an appropriate filter 58 may be selected. For example, in a commercial environment it may be beneficial to include a filter 58 formed of non-woven polyester and with a rating of N95. In some embodiments, the floor aperture 56 and the filter 58 may be circular-shaped. However, it should be appreciated that the floor aperture 56 and the filter 58 may be other shapes such as rectilinear.

Figure 3:
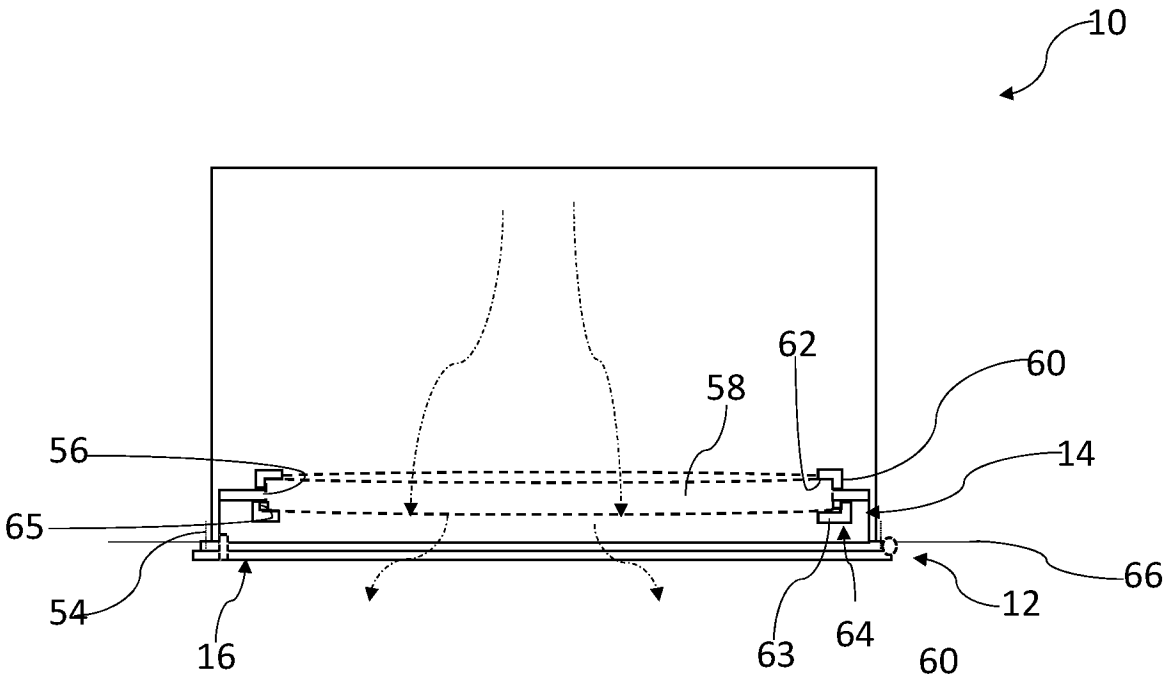
FIG. 3 is a cross-sectional side view of the air diffuser assembly according to an aspect of the present disclosure.

With reference now to FIG. 3, a cross-section of the air diffuser assembly 10 is illustrated. The filter 58 may be retained within the floor aperture 56 via a sleeve 60 that extends from one or both sides of the floor 44 between a cavity side that faces the cover 16 and a HVAC side that faces into the interior of the duct. In some embodiments, the sleeve 60 is annularly shaped for housing the filter 58, which may be circular. In some embodiments, the HVAC side defines an inwardly directed flange 62 for seating against the filter 58. In some embodiments, the cavity side defines at least one holding device 64, such as a clip, a threaded surface, a cap, or a combination thereof to selectively removed and replace the filter 58. In some embodiments, the holding device 64 includes an annular cap 63 with a threaded inner or outer surface and the sleeve 60 includes a threaded inner or outer surface for threaded engagement 65 with the annular cap 63. FIG. 3 further illustrates the air diffuser assembly 10 located within a wall 66 of a commercial or residential space. In some embodiments, the hinge 52 is located adjacent to one of the peripheral sidewalls 22 and an outer portion of the top flange 46 of the body 14.

Figure 4:
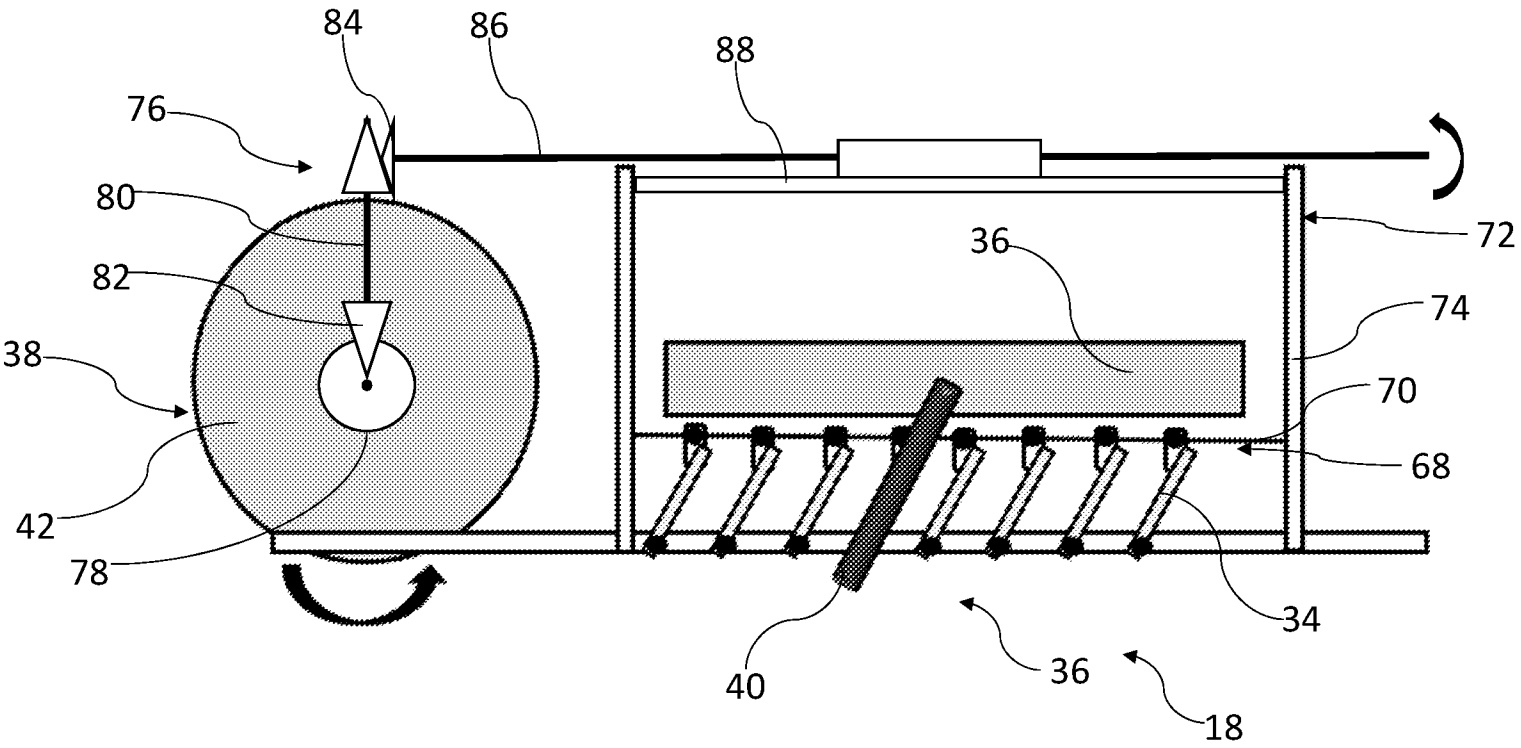
FIG. 4 is a cross-sectional side view of a vent in the air diffuser assembly according to an aspect of the present disclosure.
Figure 5:
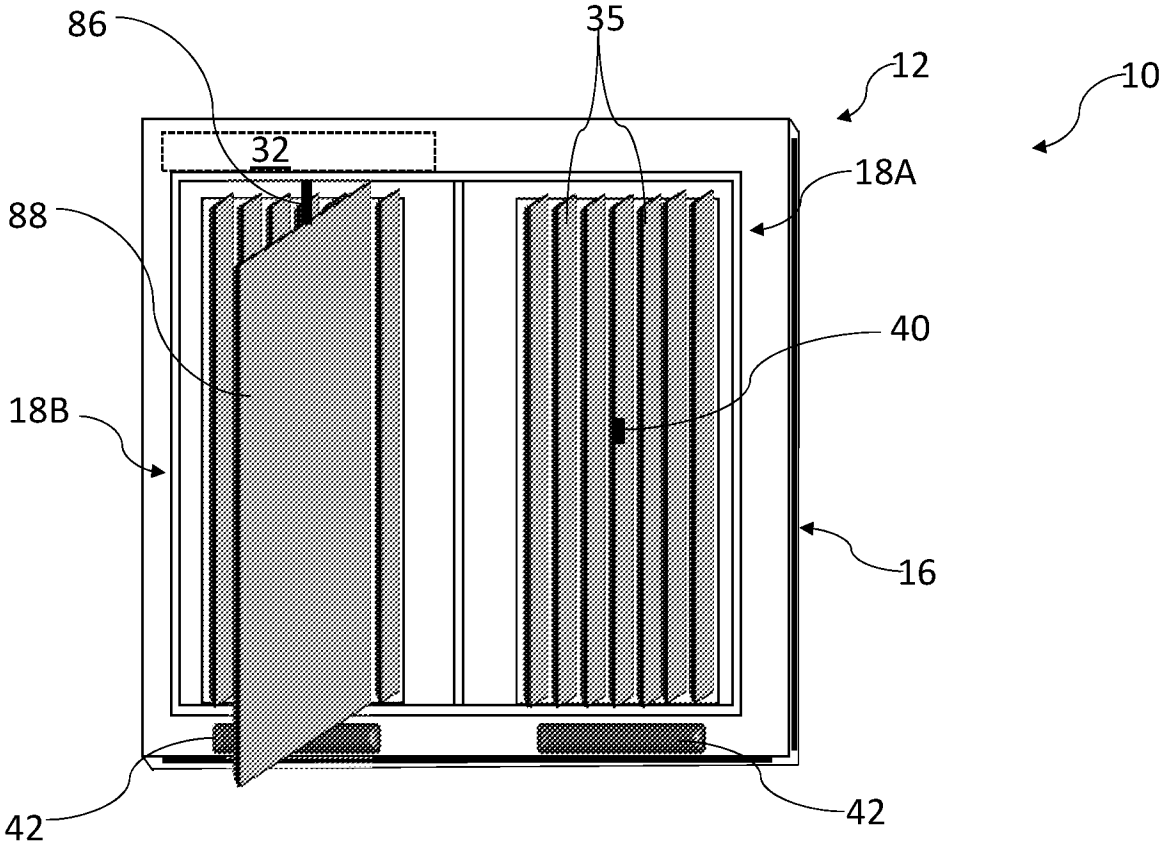
FIG. 5 is a bottom view of a cover of the air diffuser assembly according to an aspect of the present disclosure.

With reference now to FIG. 4, the vent assembly 18 is illustrated from a cross-sectional perspective in accordance with some embodiments. The directional control 36 is illustrated as connected to the outer blades 34 and the inner blades 35. More particularly, the tab 40 of the directional control 36 may be slideably connected to one of the outer blades 34 and connected to one of the inner blades 35. The outer blades 34 may be transverse (e.g., perpendicular) to the inner blades 35. As such, in use, the tab 40 may be pivoted in an upward or downward position (e.g., a first bi-directional axis) to orientate the outer blades 34 and slid in a cross-wise direction (e.g., a second bi-directional axis) to orient the inner blades 35. The outer blades 34 may be connected to the cover 16 via a pivot linkage 68 that includes at least one elongated member 70 and portion of the cover 16 located and pivotally connected on opposite sides of the outer blades 34. A similar pivot linkage (not shown) may be included for movement of the inner blades 35. Each vent 18 may further include a vent gateway 72 that includes a plurality of sidewalls 74 extending about the vent 18 into the cavity 50. In some embodiments, the flow adjustment wheel 42 may be connected to the adjustment flow valve 37 via a gear mechanism 76. In some embodiments, the gear mechanism 76 may include a first bevel gear 78 connected to the flow adjustment wheel 42 and a shaft 80 with a pair of oppositely located shaft gears 82 and a second bevel gear 84 rotationally connected to a valve shaft 86. A valve plate 88 may be connected to the valve shaft 86. As such, rotation of the flow adjustment wheel 42 causes similar rotation of the valve shaft 86 and the valve plate 88. FIG. 5 illustrates a bottom view of the cover 16 from FIG. 1. The flow valve 37 is removed from one of the vents 18 for illustrating the connection between the tab 40 and one of the inner blades 54. In some embodiments, a vent gateway 72 may be located around more than one vent assembly 18 and the valve plate 88 may control the flow rate to more than one vent assembly 18.

Figure 7:
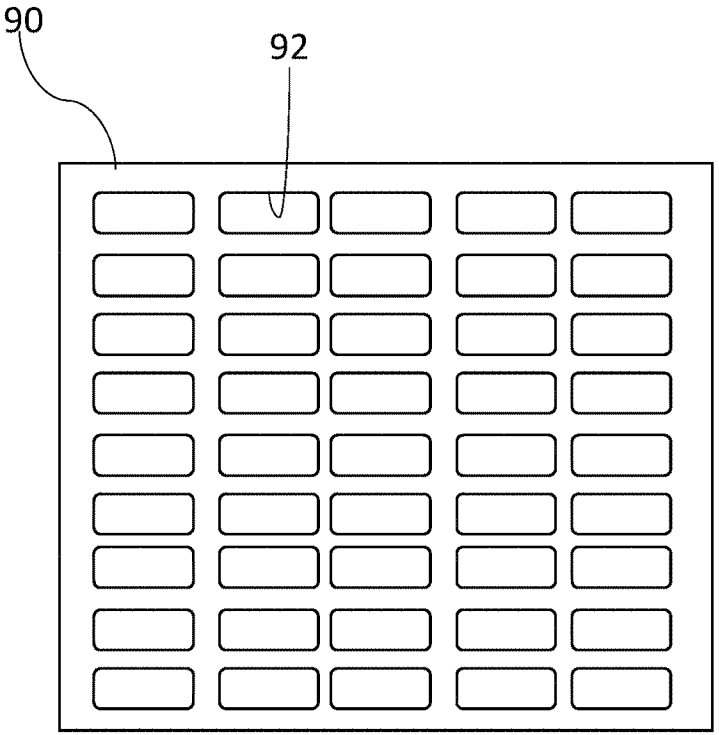
FIG. 7 is a top view of the grate according to an aspect of the present disclosure.
Figure 6:
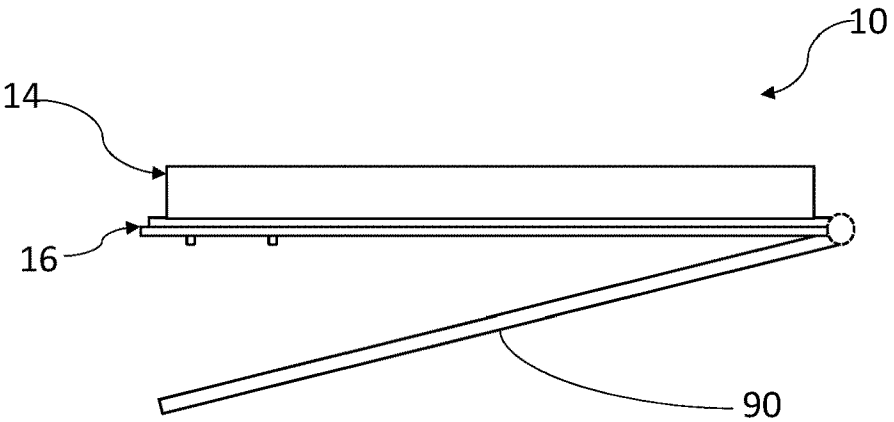
FIG. 6 is a side view of an air diffuser assembly with a protective grate according to an aspect of the present disclosure.

FIGS. 6 and 7 illustrate an air diffuser assembly 10 having a protective grate 90. The protective grate 90 may be connected to the hinge 52 and moveable between a protective position (FIG. 7), wherein protective grate 90 is located over the cover 16 and protects various parts thereof (e.g., the vent assembly 18 or the user interface 24) and a non-protective position (FIG. 6), wherein protective grate 90 is moved or pivoted away from the cover 16 and permits access to various parts thereof (e.g., the vent 18 or the user interface 24). The protective grate 90 may be particularly useful when installed into a floor and may define a series of air holes 92 for permitting the air to pass therethrough.

Figure 8:
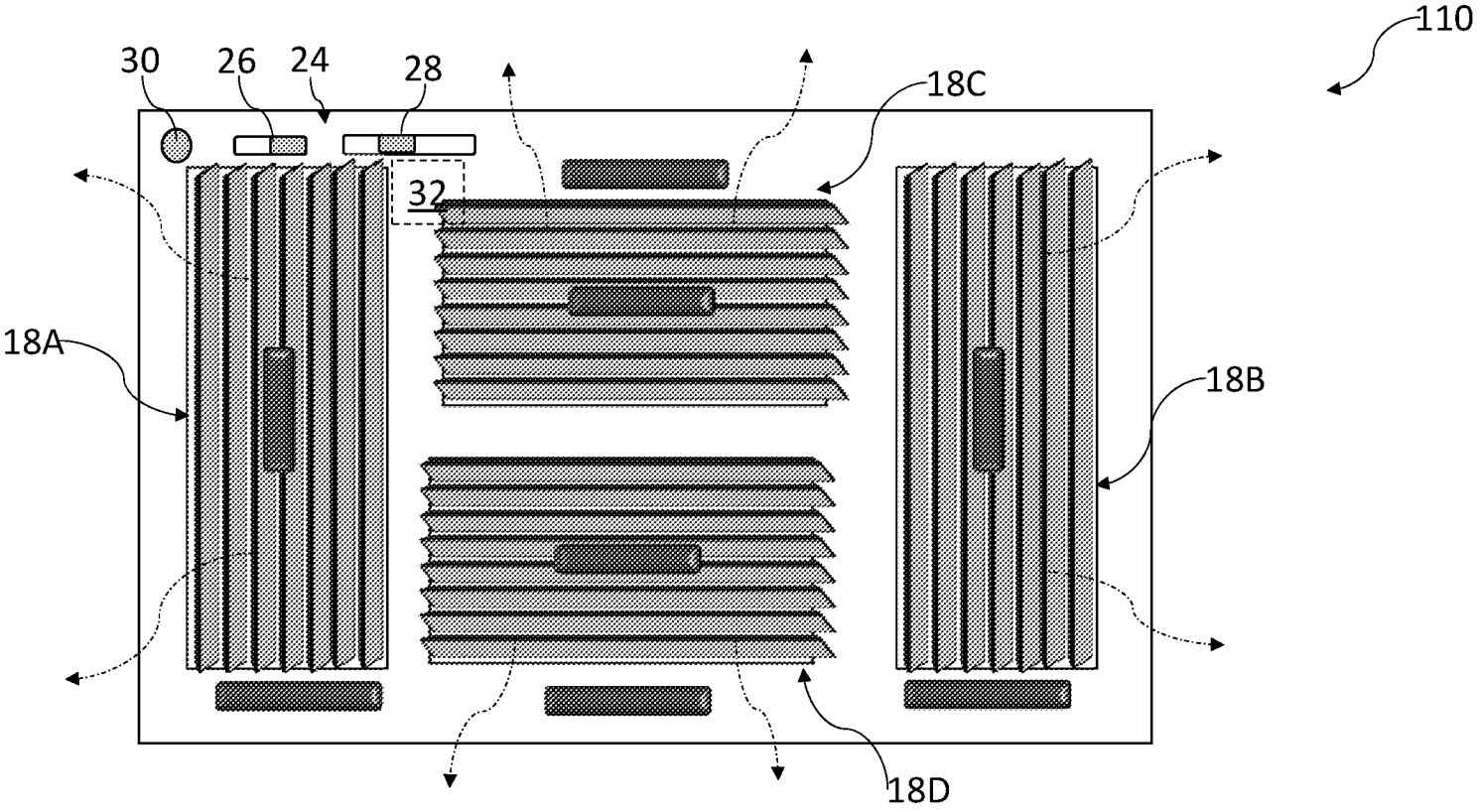
FIG. 8 is top view of a second embodiment of the air diffuser assembly according to an aspect of the present disclosure.

FIG. 8 illustrates a second embodiment of the air diffuser assembly 110. Unless otherwise detailed, the second embodiment may share all of the same features, materials, and constructions as the first embodiment. However, the orientation and number of the vents 18 of the second embodiment have been changed from the first embodiment. More particularly, the air diffuser assembly 110 includes a pair of vertical vents 18A, 18B spaced from one another and a pair of horizontal vents 18C, 18D located there between.

Figure 9:
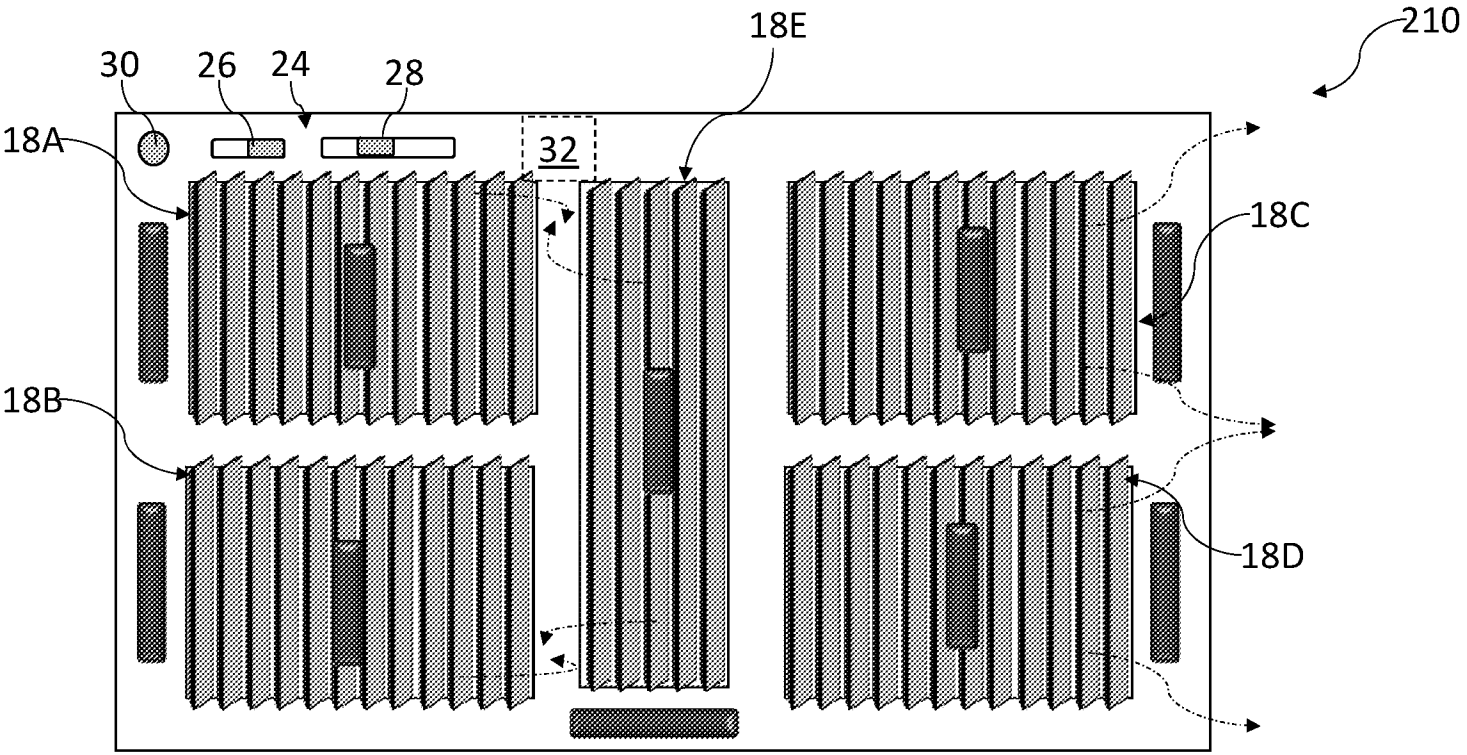
FIG. 9 is top view of a third embodiment of the air diffuser assembly according to an aspect of the present disclosure.

FIG. 9 illustrates a third embodiment of the air diffuser assembly 210. Unless otherwise detailed, the third embodiment may share all of the same features, materials, and constructions as the first embodiment. However, the orientation and number of the vents 18 of the third embodiment have been changed from the first and second embodiments. More particularly, the air diffuser assembly 100 includes a pair of horizontal vents 18A, 18B spaced from another pair of horizontal vents 18C, 18D and a vertical vent 18E located there between.

Figure 10:
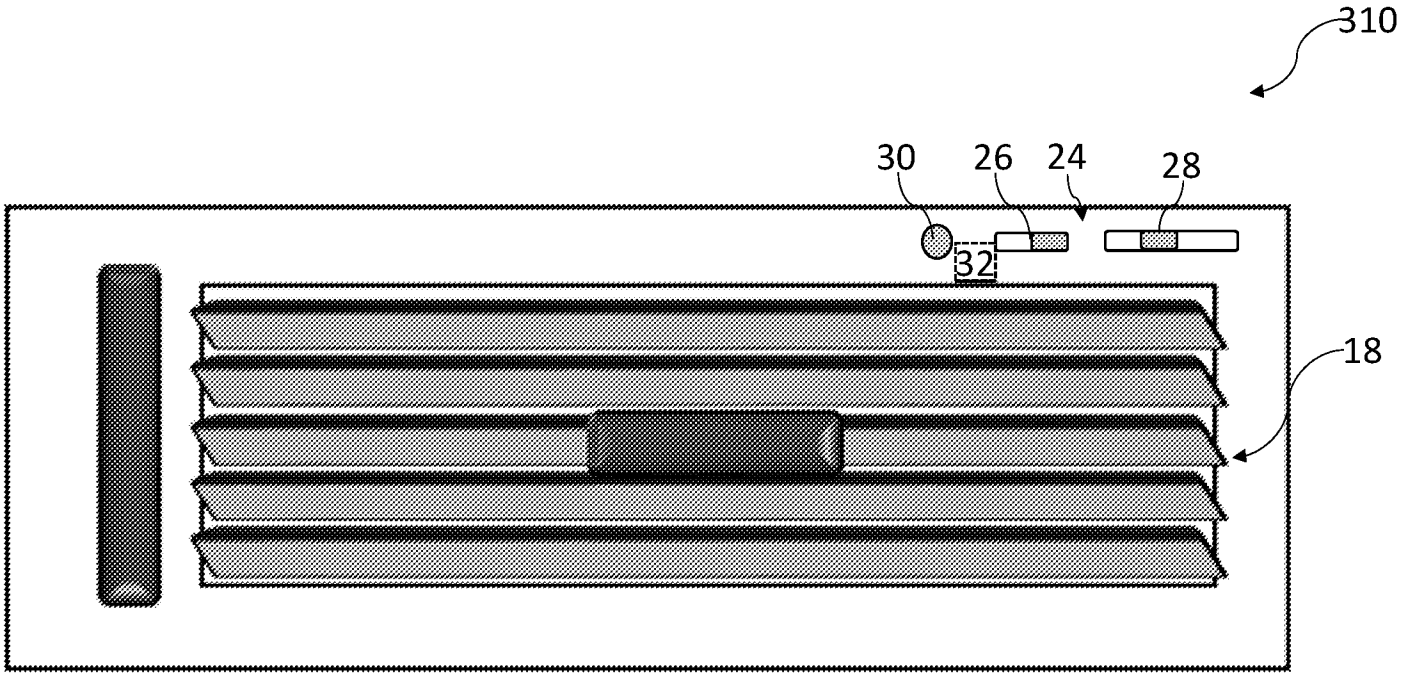
FIG. 10 is top view of a fourth embodiment of the air diffuser assembly according to an aspect of the present disclosure.

FIG. 10 illustrates a fourth embodiment of the air diffuser assembly 310. Unless otherwise detailed, the fourth embodiment may share all of the same features, materials, and constructions as the first embodiment. However, the orientation and number of the vents 18 of the fourth embodiment have been changed from the other embodiments. More particularly, the air diffuser assembly 100 includes a single vent 18.

The variations of the orientation and number of the vents 18 may each be beneficial for various environments. For example, the air diffuser 10 may be beneficial in circumstances with two or more persons located (e.g., working) on opposite sides thereof, the air diffuser assembly 110, 210 may be beneficial in circumstances with four or more persons located on opposite sides thereof, and the air diffuser assembly 310 may be beneficial in circumstances with one person.

Figure 11:
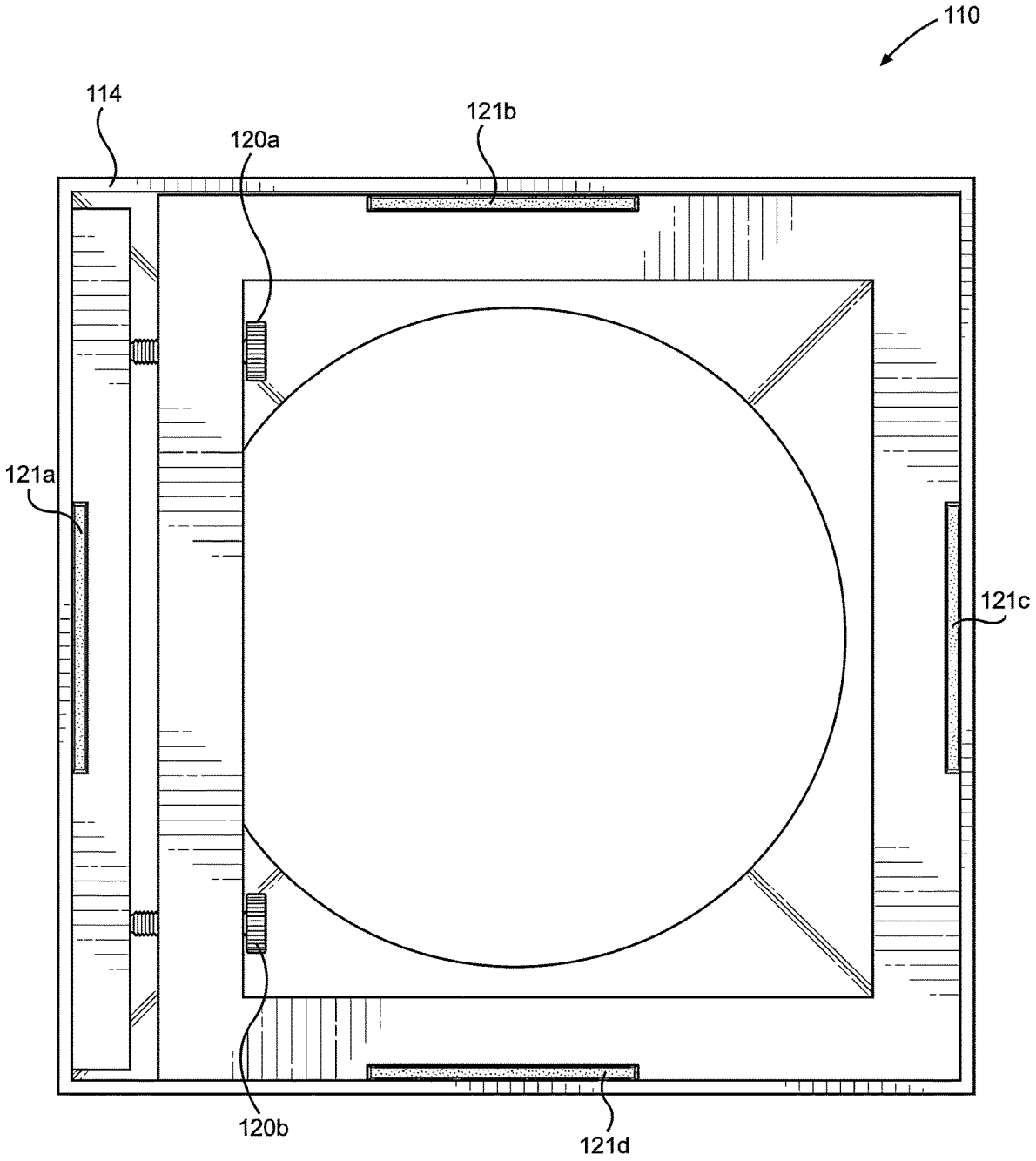
FIG. 11 is a bottom view of a body of a fifth embodiment of the air diffuser assembly according to an aspect of the present disclosure.

FIG. 11 illustrates a fifth embodiment of the air diffuser assembly 510. Unless otherwise detailed, the fifth embodiment may share all of the same features, materials, and constructions as the first embodiment.

With reference to FIG. 11, the body 514 of the air diffuser assembly 510 may comprise two or more screws 520*a*, 520*b* to secure the air diffuser assembly 510 in place within a surface opening 550. The surface opening 550 may be an opening within a wall, ceiling, or floor. The body 514 comprises one or more magnets 521*a*, 521*b*, 521*c*, 521*d* positioned on a lower surface of the body 514 to secure the cover 516 (not shown) into a closed position.

Figure 12:
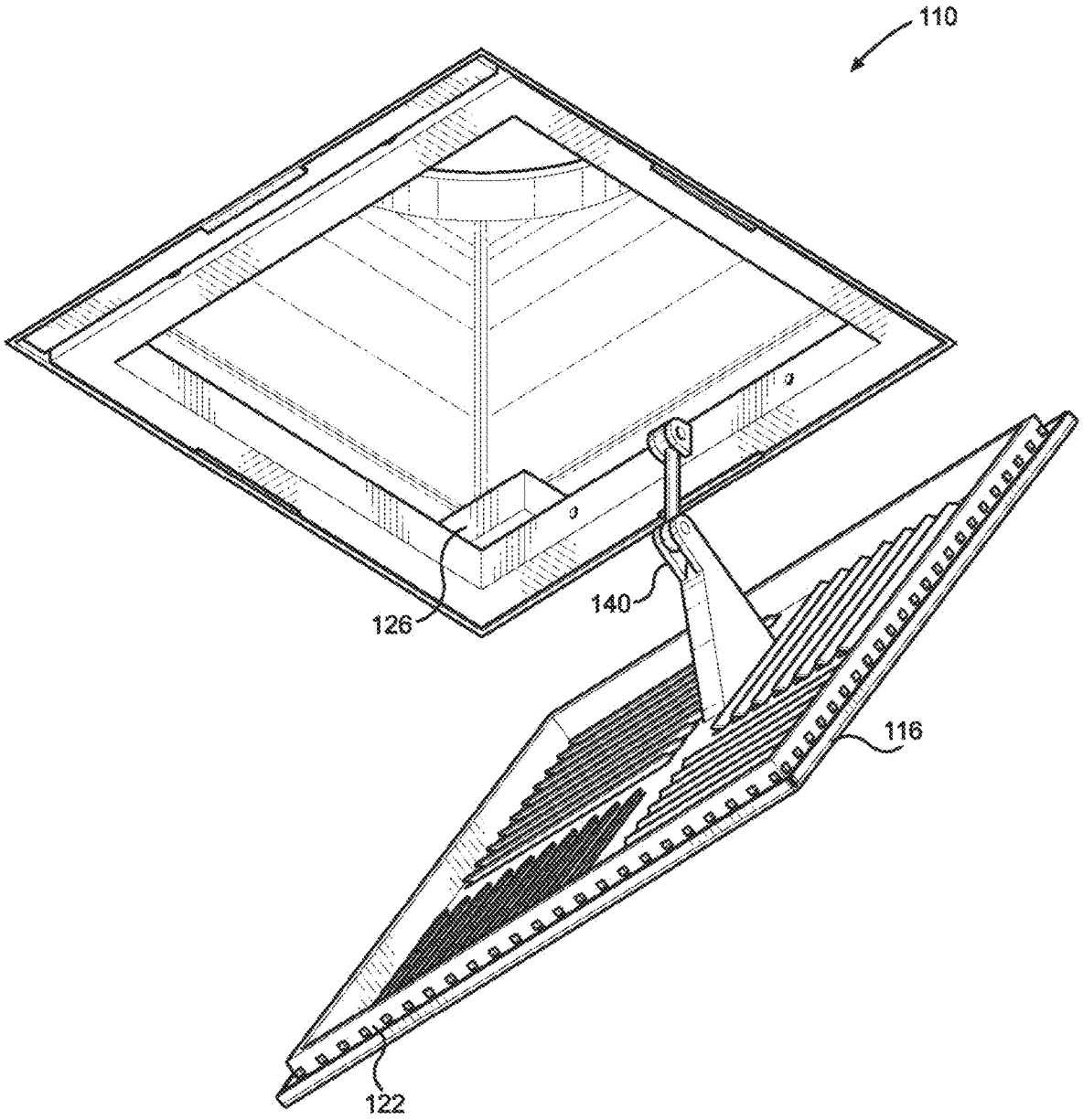
FIG. 12 is a perspective view of the body and a cover of the fifth embodiment of the air diffuser assembly in an open configuration according to an aspect of the present disclosure.

As illustrated in FIG. 12, the fifth embodiment of the air diffuser assembly 510 comprises a double-pivot arm 540 removably affixed on one end to an interior surface of the body 514, and removably affixed on the other end to a top surface of the cover 516. FIG. 12 depicts the air diffuser assembly 510 in an open configuration, such that the double-pivot arm 540 allows access and maintenance of the surface opening 550, the vent opening, or of the air diffuser assembly 510 and its parts. The double-pivot arm 540 prevents interference with the surface opening 550 while the air diffuser assembly 510 is in the open configuration.

Figure 13:
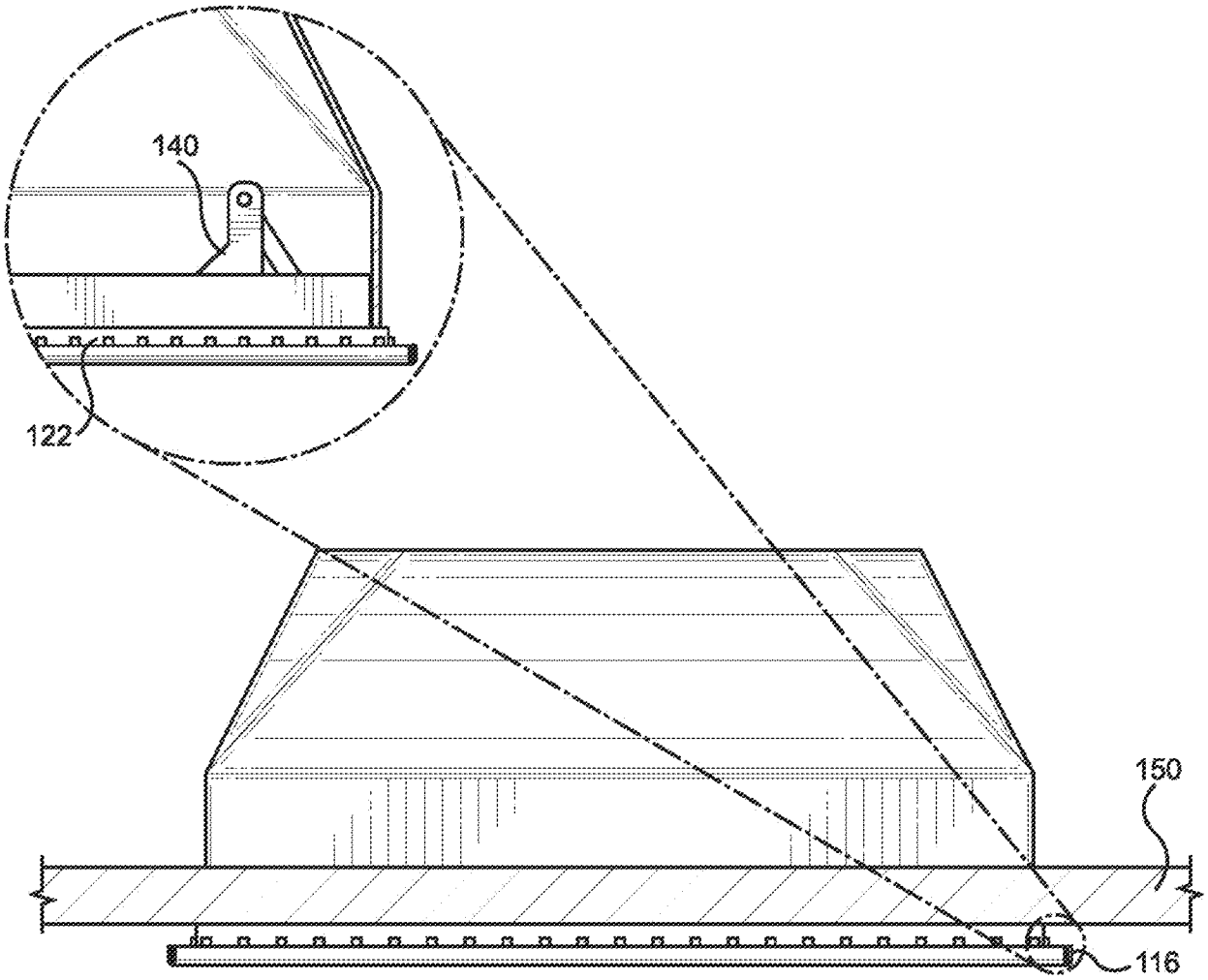
FIG. 13 is a side view of the fifth embodiment of the air diffuser assembly in a closed configuration according to an aspect of the present disclosure.

As illustrated in FIG. 13, the double pivot arm 540 folds in on itself to provide a seamless junction between the top of the cover 516 and the surface opening 550. By applying force to the cover 516 in the direction of the body 514, a user may transition the air diffuser assembly 510 from the open configuration to the closed configuration, wherein the one or more magnets 521*a-d* magnetically secure the cover 516 in the closed configuration. To transition the air diffuser assembly 510 from the closed configuration to the open configuration, a user may apply sufficient force to the cover 516 in a direction away from the body 514 to release the cover 516 from the one or more magnets 521*a-d*, and extend the double pivot arm 540 so that the air diffuser assembly 510 transitions to an open configuration.

Figure 22:
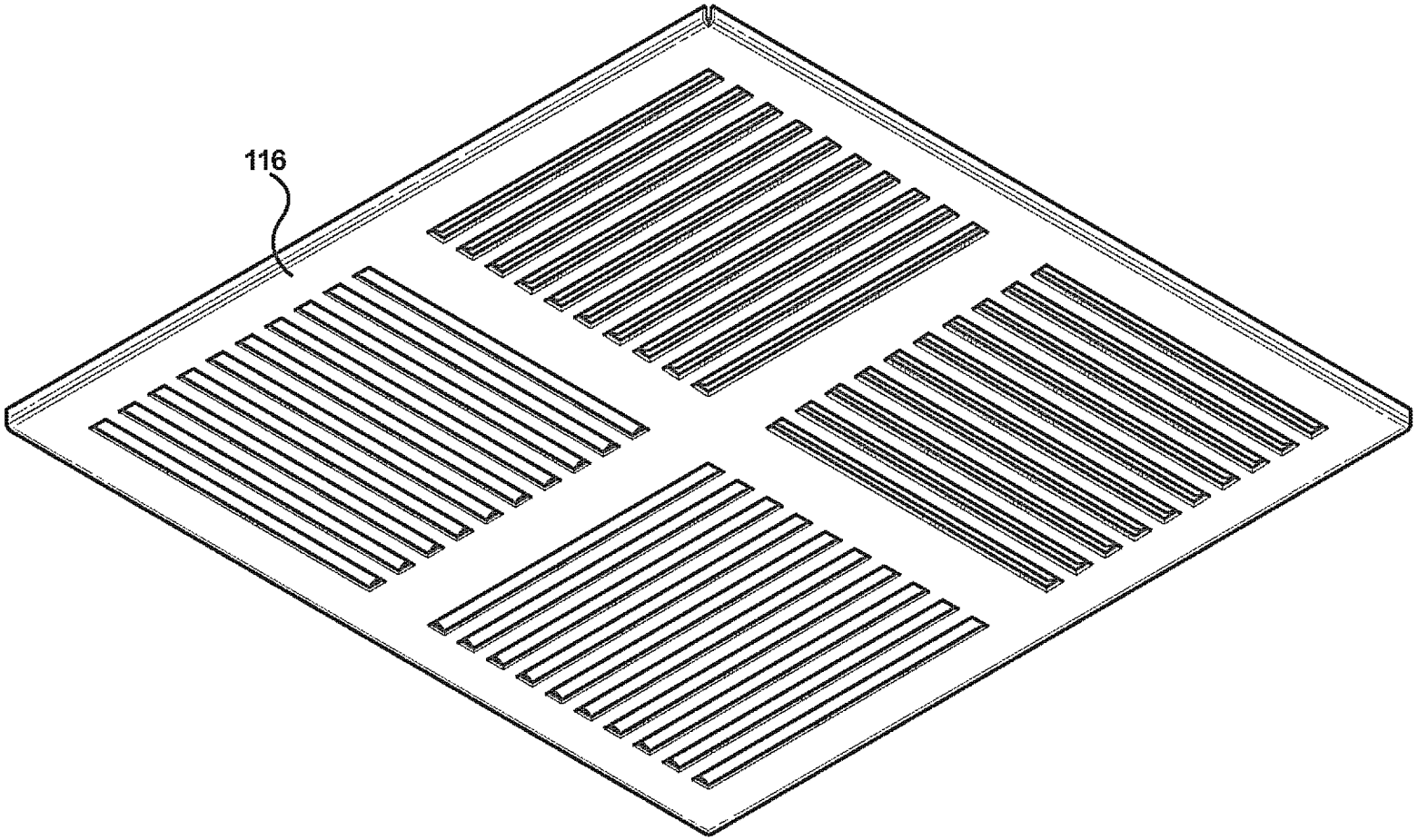
FIG. 22 is a perspective view of the bottom side of the cover of the fifth embodiment of the air diffuser assembly according to an aspect of the present disclosure.

Conventional air vents use visible screws or latching mechanism on the lower surface of a vent cover to secure the cover in place. The magnetic connection of the fifth embodiment of the air diffuser assembly 510, between the body 514 and the cover 516, allows the cover 516 to be removably affixed to the surface opening 550 without the use of visible screws or latching mechanisms on the lower surface of the cover 516 for a more aesthetically preferred appearance as shown in FIG. 22, while also easing the process for accessing the inner components of the air diffuser assembly 510 and the ventilation system.

Figure 14:
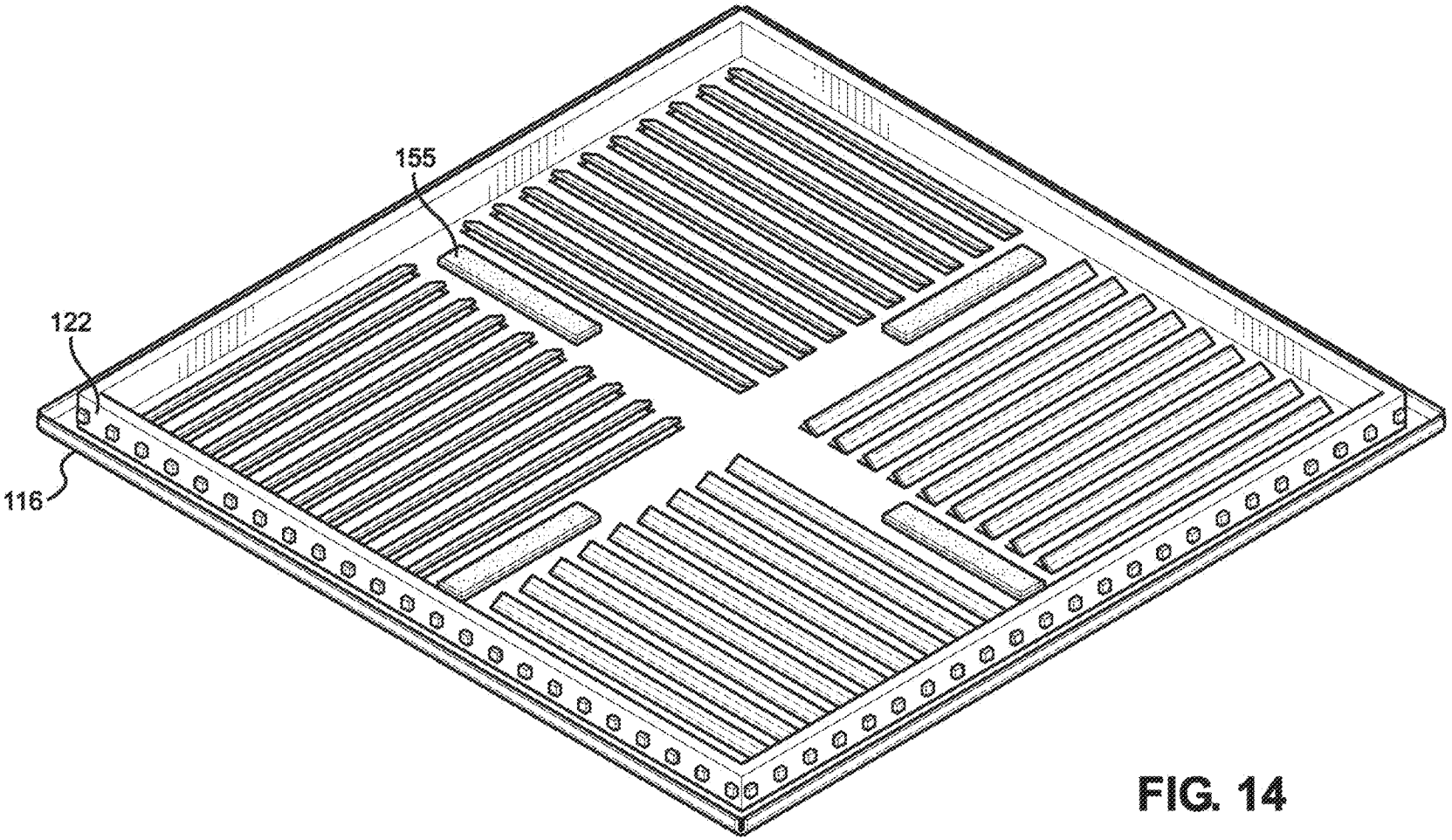
FIG. 14 is a perspective view of a top side of the cover of the air diffuser assembly according to an aspect of the present disclosure.

As illustrated in FIG. 13, the cover 516 has sufficient depth that when a top surface of the cover 516 is seamlessly joined to the surface opening 550, a bottom surface of the cover 516 is positioned some distance away from the surface opening 550. Sidewalls of the cover 516 span the depth of the cover 516 between the cover's top surface and bottom surface. FIGS. 13 and 14 illustrate a source of illumination such as an LED strip 522 comprising a plurality of lights removably affixed to an outer side of the sidewalls of the cover 516. The LED strip 522 is configured to provide ambient light to the air diffuser assembly's environment.

As illustrated in FIG. 14, a top surface of the cover 516 may comprise another source of illumination such as one or more ultraviolet (UV) lights 555 removably affixed to a top surface of the cover 516 to kill bacteria and disinfect the HVAC vent and/or air diffuser assembly.

As described in other embodiments of the invention, the cover 516 may comprise a motion sensor configured to detect movement within a predetermined distance from the air diffuser assembly 510. The motion sensor may be calibrated to detect motion within the predetermined distance as selected and set by a user. The cover 516 may also comprise a photo sensor configured to detect light in an area adjacent to the air diffuser assembly. The photo sensor may be calibrated to detect light within a predetermined distance from the air diffuser assembly which exceeds a predetermined light level threshold selected and set by a user. During use of the air diffuser assembly, when the motion sensor detects movement within the predetermined distance, the source of illumination, e.g., the LED strip 522, switches from an off configuration to an on configuration if the photo sensor detects a level of light that exceeds the predetermined threshold in the area adjacent to the air diffuser 510, thereby providing ambient light to the area adjacent the air diffuser assembly 510 such a dark room or hallway.

Figure 15:
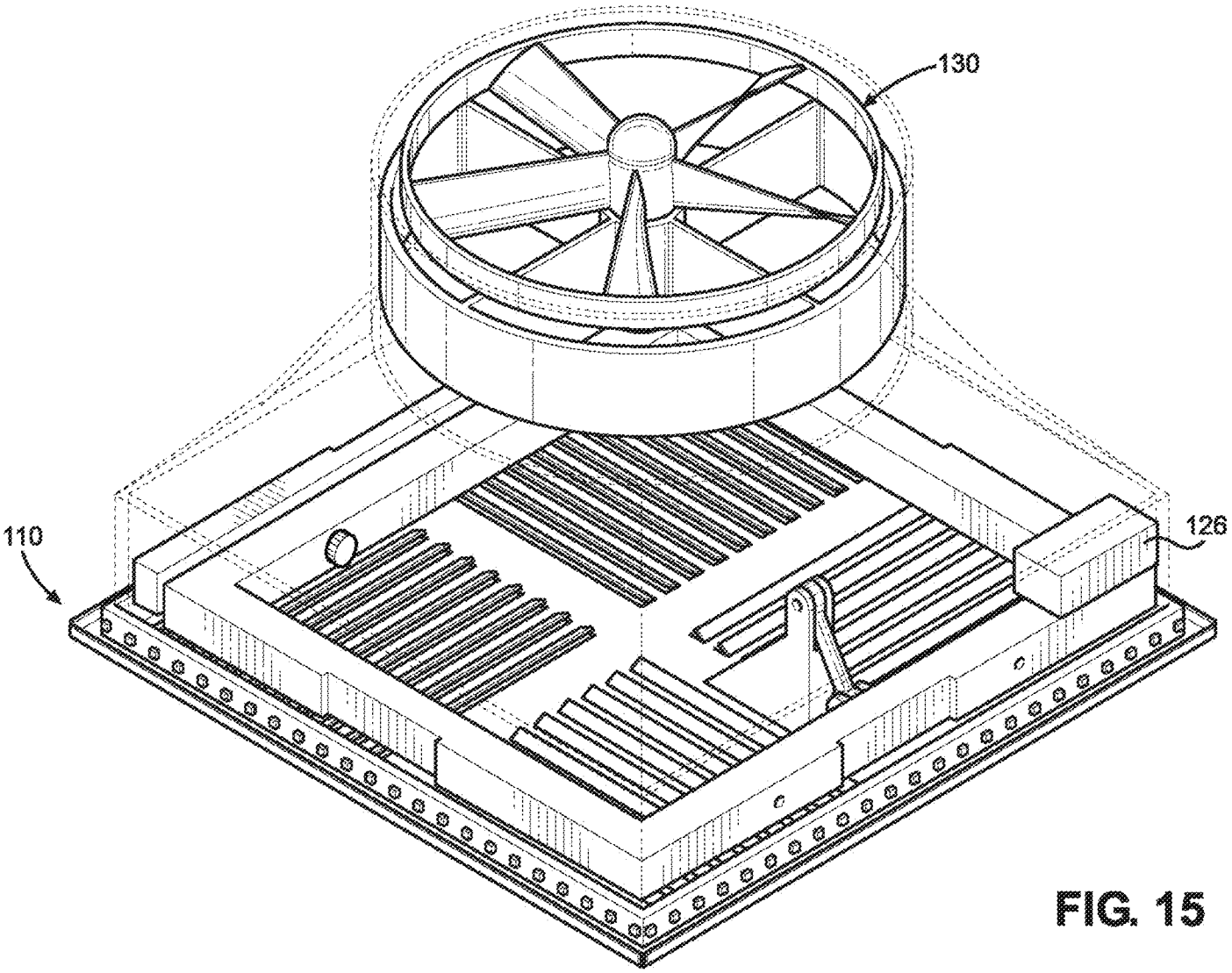
FIG. 15 is a perspective view of a passive charging system of the fifth embodiment of the air diffuser assembly shown in a closed configuration according to an aspect of the present disclosure.

FIG. 15 illustrates a passive charging system of the fifth embodiment of the air diffuser assembly 510. The passive charging system is removably secured to an inner surface of the body 514 through a mounting frame 535, and is electrically connected to a rechargeable battery 526 removably secured to the body 514. The rechargeable battery 526 is electrically connected to the LED strip 522, the one or more ultraviolet lights 555, the motion sensor, the photo sensor and a user interface to supply power to each of these components and illuminate the LED strip 522 and the one or more ultraviolet lights 555.

Figure 16:
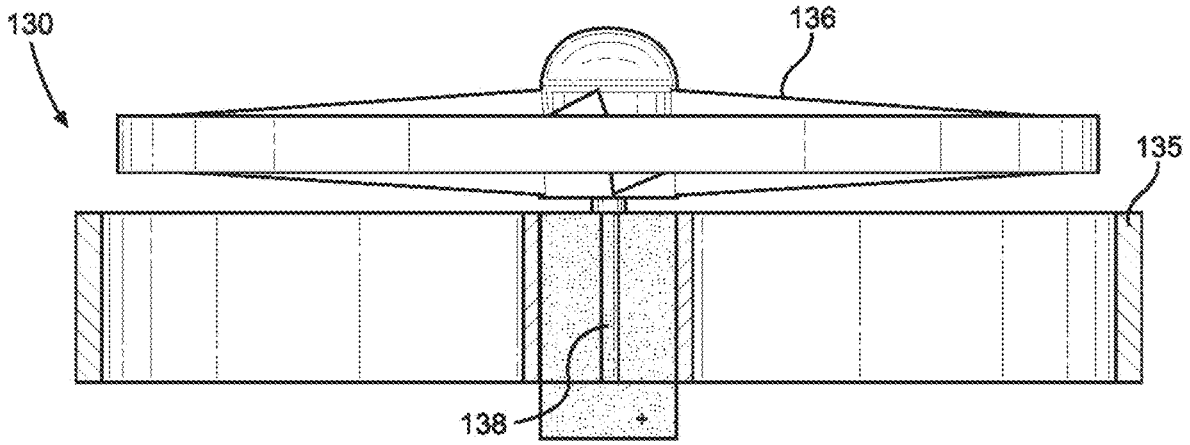
FIG. 16 is a side view of a passive charging system of the air diffuser assembly according to an aspect of the present disclosure.
Figure 17:
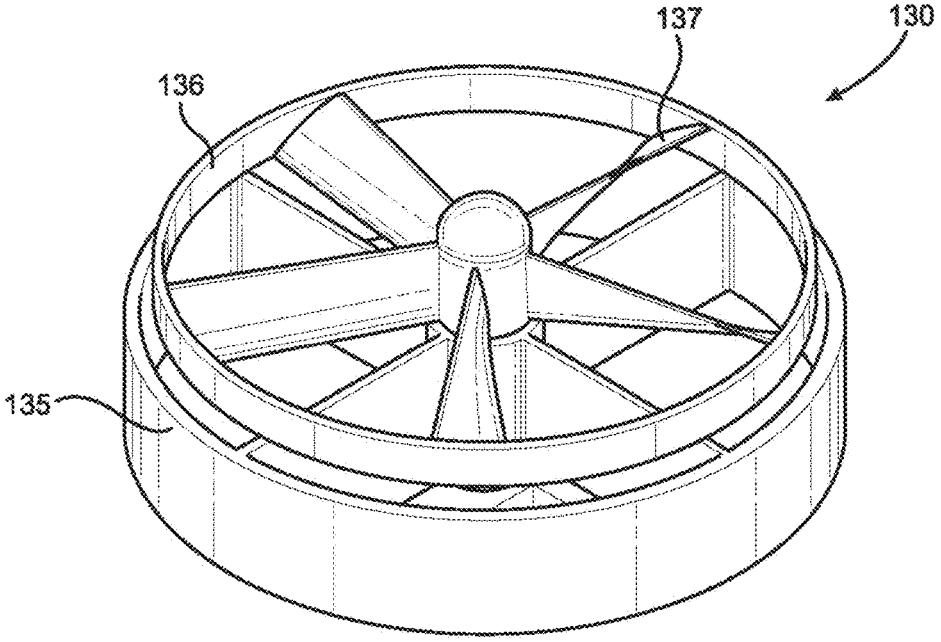
FIG. 17 is a perspective view of a passive charging system of the air diffuser assembly according to an aspect of the present disclosure.
Figure 18:
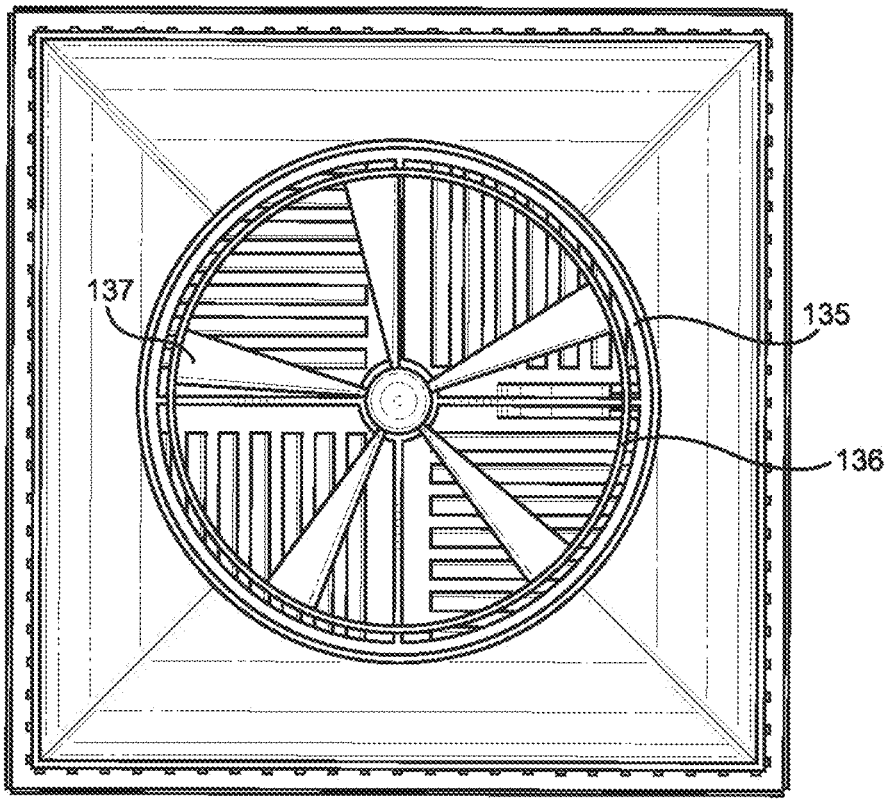
FIG. 18 is a top view of the fifth embodiment of the air diffuser assembly in a closed configuration according to an aspect of the present disclosure.

FIGS. 16-18 illustrate certain components comprising the passive charging system. The passive charging system is a turbine generator assembly 530 comprising a mounting frame 535, fan 536, and a rotor shaft 538. The passive charging system is positioned within the body 514 of the air diffuser assembly 510 on the mounting frame 535 such that air passing through the air ventilation system traverses the fan blades 536 of the turbine generator 535.

Figure 19:
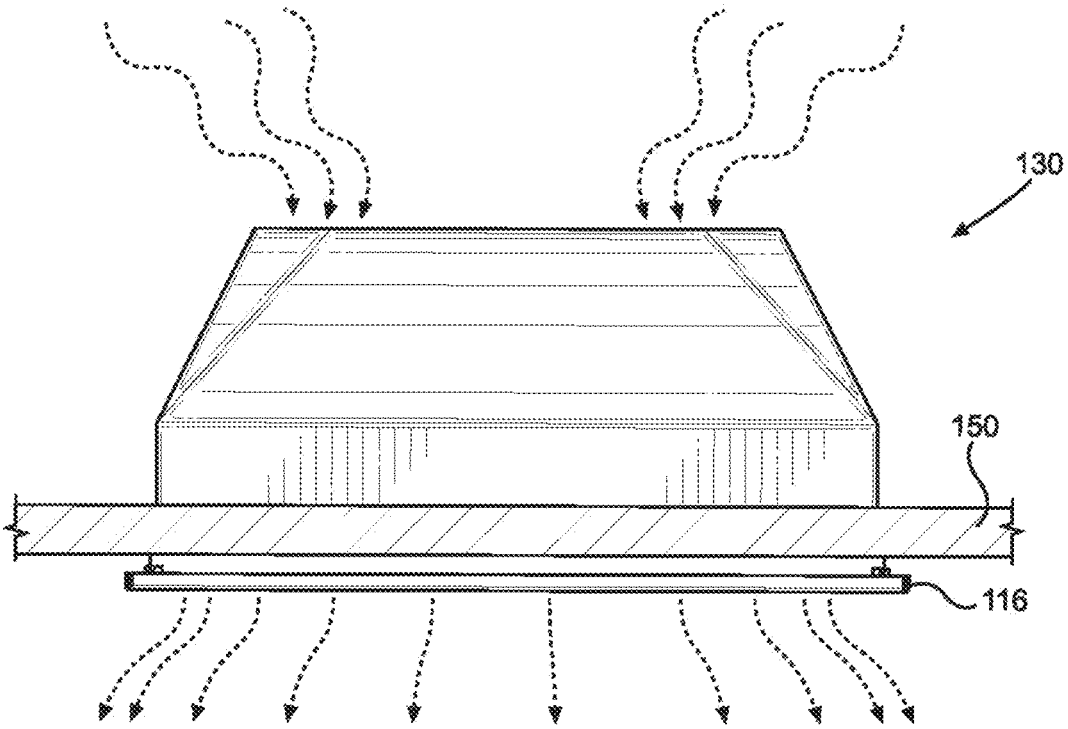
FIG. 19 is a side view of the body and cover of the fifth embodiment of the air diffuser assembly installed in a closed configuration according to an aspect of the present disclosure.

FIG. 19 illustrates an example of air flowing through the air ventilation system into the air diffuser assembly 510 through the passive charging system. As the air passes across the fan blades 536, the fan blades cause the rotor shaft 538 to rotate. Thus, the mechanical or kinetic energy provided by the flow of air spins the rotor shaft 538 allowing the turbine generator 535 to convert the mechanical energy into electrical energy, which is transferred through an electrical connection to the rechargeable battery 526 where the electrical energy is stored. The rechargeable battery 526 is electrically connected and provides power to the LED strip 522 and the ultraviolet lights 555.

As described in other embodiments of the invention, the cover 516 may further include a user interface that includes a settings selector and a brightness selector. The setting selector may permit a user to input, store, and/or change one or more settings of the sources of illumination, the motion sensor, and/or the photo sensor. The illumination settings may include on/off settings for motion sensing, light detection, scheduled illumination, color of illumination, or combinations thereof. The illuminations settings may also allow a user to adjust the intensity or brightness of the sources of illumination. The user interface may comprise a manual user interface located on the cover 516 and/or a wireless user interface remotely connected to the air diffuser assembly 510 allowing the user to adjust the settings selector using a cellular phone app or desktop application.

One of ordinary skill in the art would appreciate that the selection and use of the most efficient and suitable turbine generator configuration for a particular application will depend upon the airflow tendencies of that specific HVAC system. Therefore, selection of the components of the passive charging system may require the use of alternative sizes and fan designs to maximize charging efficiency of the rechargeable battery and limit or reduce the undesired vibrations that may be heard when a less efficient turbine generator assembly is used.

By way of example, the turbine generator 530 uses a standard fan configuration which is suitable for most applications because it is sized and shaped to effectively meet most household needs.

Figure 20:
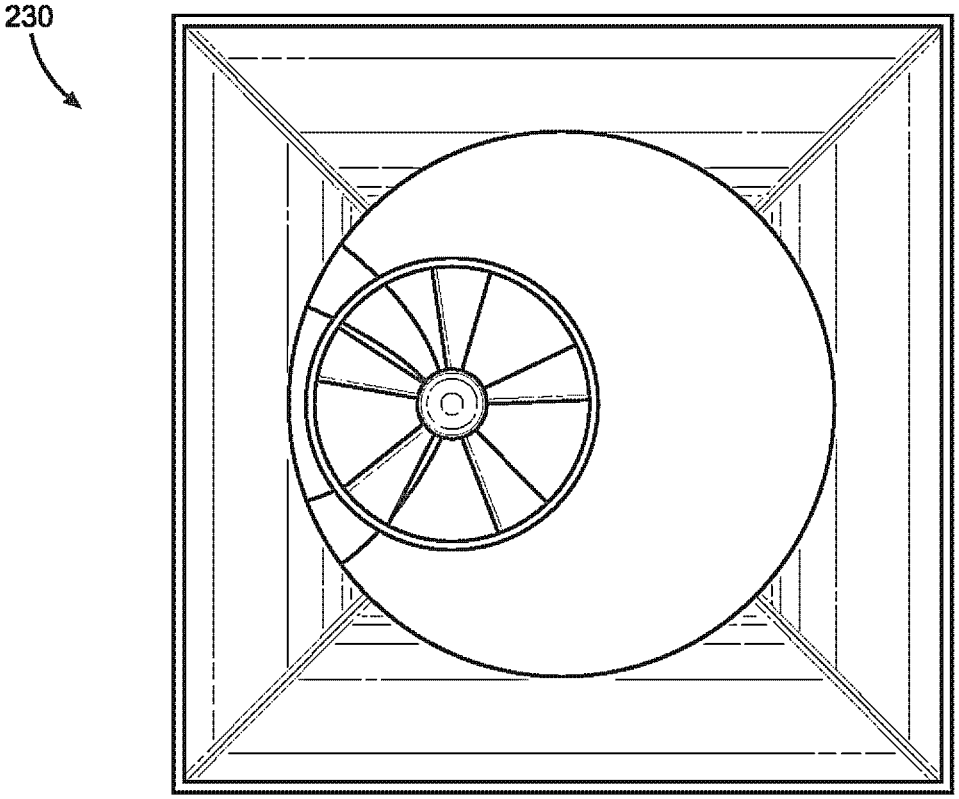
FIG. 20 is a bottom view of a second embodiment of the passive charging system according to an aspect of the present disclosure.
Figure 21:
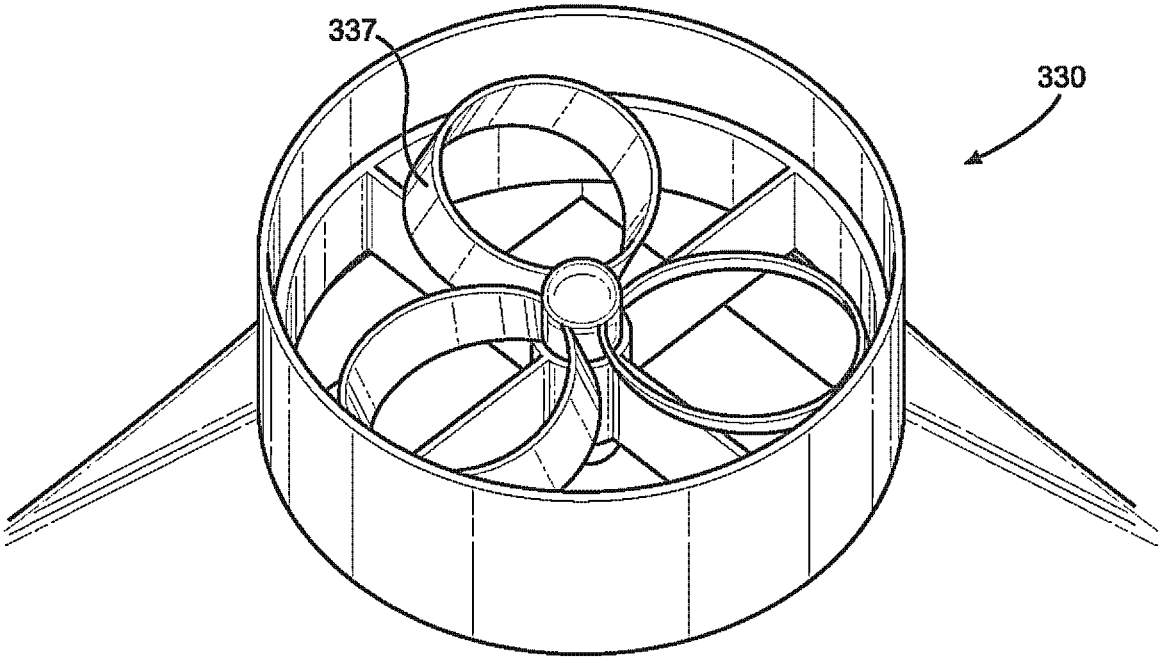
FIG. 21 is a perspective view of a third embodiment of the passive charging system according to an aspect of the present disclosure.

FIGS. 20 and 21 illustrate a second embodiment of the turbine generator assembly 630 and a third embodiment of the turbine generator assembly 730, respectively. These illustrative examples are a non-exhaustive demonstration of fan configurations that may be used with the passive charging system, such that one of ordinary skill in the art may select the most appropriate fan assembly through routine experimentation.

FIG. 20 illustrates the use of a smaller turbine generator assembly 630. The use of a scaled down fan may reduce noise by decreasing the speed of the fan blade rotation and increasing the blow-by of the system.

FIG. 21 illustrates the use of a turbine generator assembly 730 with a toroidal fan more suitable for high volume airflow applications where the fan may be spinning at high speeds. Use of a standard fan style, such as that shown in FIGS. 15-18, with higher volumes of airflow may cause vibration of the air diffuser assembly 510 components resulting in loud noises. The use of a toroidal fan such as that shown in FIG. 21 reduces the vibration and noise.

Many modifications and variations of the present invention are possible in light of the above teachings and may be practiced otherwise than as specifically described. In addition, the reference numerals are merely for convenience and are not to be read in any way as limiting. Note that not all of the activities described above in the general description or the examples are required, that a portion of a specific activity may not be required, and that one or more further activities may be performed in addition to those described. Still further, the orders in which activities are listed are not necessarily the order in which they are performed. The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Furthermore, certain features are, for clarity, described herein in the context of separate embodiments, may also be provided in combination in a single embodiment. Conversely, various features that are, for brevity, described in the context of a single embodiment, may also be provided separately or in any sub combination.

What is claimed:

1. An air diffuser assembly for transferring airflow from a duct to an environment, the air diffuser assembly comprising:

a user interface for inputting, storing, and changing a user's preferred settings for the air diffuser assembly;

a body for being at least partially located in the duct and a cover including at least one vent assembly for permitting the airflow through the cover and into the environment;

the body defining an aperture for transferring the airflow from the duct and an air filter located in the aperture;

the cover including a closed position, wherein the cover is placed against the body to form a cavity, and an open position, wherein the cover is moved from the body to permit access to the filter;

wherein the cover includes an outer peripheral sidewall defining a thickness and a source of illumination is located on the outer peripheral sidewall; and wherein the cover further includes a motion sensor and a photo sensor configured to provide ambient light to the air diffuser assembly's environment when movement is detected within a predetermined distance from the air diffuser assembly.

2. The air diffuser assembly of claim 1, wherein the user interface includes at least one of a manual user interface located on the cover and a wireless user interface remotely connected to the air diffuser assembly.

3. The air diffuser assembly of claim 2, wherein the source of illumination, the motion sensor, and the photo sensor are powered by a rechargeable battery connected to a passive charging system.

4. The air diffuser assembly of claim 3, wherein the passive charging system is comprising a turbine generator and a rechargeable battery.

5. The air diffuser assembly of claim 4, wherein the airflow from the duct rotates a fan and a rotor shaft of the turbine generator to create kinetic energy, and the turbine generator converts the kinetic energy to electrical energy which is transferred to and stored by a rechargeable battery connected to the turbine generator.

6. The air diffuser assembly of claim 5, wherein the rechargeable battery is configured to provide power to the source of illumination, the motion sensor, and the photo sensor.

7. The air diffuser assembly of claim 6, wherein the motion sensor is configured to detect movement within a predetermined distance from the air diffuser assembly and the photo sensor is configured to detect light in an area adjacent to the air diffuser assembly.

8. The air diffuser assembly of claim 7, wherein the source of illumination switches from an off configuration to an on configuration when the motion sensor detects movement within the predetermined distance from the air diffuser assembly if the photo sensor detects a level of light in the area adjacent to the air diffuser assembly that is below a predetermined threshold light level.

9. The air diffuser assembly of claim 8, wherein the source of illumination emits light at a level of brightness selected by a user through the user interface.

10. The air diffuser assembly of claim 9, wherein a size and shape of the fan is selected to maximize the charging efficiency of the rechargeable battery and reduce vibrations.

11. An air diffuser assembly for transferring airflow from a duct to an environment, the air diffuser assembly comprising:

a user interface for inputting, storing, and changing a user's preferred settings for the air diffuser assembly;

a body for being at least partially located in the duct and a cover including at least one vent assembly for permitting the airflow through the cover and into the environment;

the body defining an aperture for transferring the airflow from the duct and an air filter located in the aperture;

wherein the cover includes an outer peripheral sidewall defining a thickness and a source of illumination is located on the outer peripheral sidewall; and wherein the cover further includes a motion sensor and a photo sensor configured to provide ambient light to the air diffuser assembly's environment when movement is detected within a predetermined distance from the air diffuser assembly.

12. The air diffuser assembly of claim 11, wherein the user interface includes at least one of a manual user interface located on the cover and a wireless user interface remotely connected to the air diffuser assembly.

13. The air diffuser assembly of claim 11, wherein the source of illumination, the motion sensor, and the photo sensor are powered by a rechargeable battery connected to a passive charging system comprising a turbine generator and a rechargeable battery.

14. The air diffuser assembly of claim 13, wherein the airflow from the duct rotates a fan and a rotor shaft of the turbine generator to create kinetic energy, and the turbine generator converts the kinetic energy to electrical energy which is transferred to and stored by a rechargeable battery connected to the turbine generator.

15. The air diffuser assembly of claim 14, wherein a size and shape of the fan is selected to maximize charging efficiency of the rechargeable battery and reduce vibrations.

16. The air diffuser assembly of claim 13, wherein the rechargeable battery is configured to provide power to the source of illumination, the motion sensor, and the photo sensor.

17. The air diffuser assembly of claim 13, wherein the motion sensor is configured to detect movement within a predetermined distance from the air diffuser assembly and the photo sensor is configured to detect light in an area adjacent to the air diffuser assembly.

18. The air diffuser assembly of claim 11, wherein the source of illumination switches from an off configuration to an on configuration when the motion sensor detects movement within the predetermined distance from the air diffuser assembly if the photo sensor detects a level of light in the area adjacent to the air diffuser assembly that is below a predetermined threshold light level.

19. The air diffuser assembly of claim 18, wherein the source of illumination emits light at a level of brightness selected by a user through the user interface.

20. An air diffuser assembly for transferring airflow from a duct to an environment, the air diffuser assembly comprising:

a user interface for inputting, storing, and changing a user's preferred settings for the air diffuser assembly;

a body for being at least partially located in the duct and a cover including at least one vent assembly for permitting the airflow through the cover and into the environment;

the body defining an aperture for transferring the airflow from the duct and an air filter located in the aperture;

wherein the cover includes an outer peripheral sidewall defining a thickness and a source of illumination is located on the outer peripheral sidewall; and wherein the source of illumination is configured to disinfect an interior of the duct.

* * * * *